US008369561B2

(12) United States Patent
Bhutani et al.

(10) Patent No.: US 8,369,561 B2
(45) Date of Patent: Feb. 5, 2013

(54) SIDEWAYS EXTENDING SPEAKER APPARATUS AND METHODS

(75) Inventors: Gurmeet Bhutani, Mohali (IN); Cheng-Hsien Wang, Lujhou (TW); Jyh-Yinn Lin, Taipei (TW)

(73) Assignee: Dell Products L.P., Round Rock, TX (US)

( * ) Notice: Subject to any disclaimer, the term of this patent is extended or adjusted under 35 U.S.C. 154(b) by 314 days.

(21) Appl. No.: 12/661,812

(22) Filed: Mar. 24, 2010

(65) Prior Publication Data

US 2011/0235847 A1 Sep. 29, 2011

(51) Int. Cl.
*H04R 25/00* (2006.01)

(52) U.S. Cl. ..... 381/395; 381/387; 381/332

(58) Field of Classification Search ..... 381/333, 381/386, 387, 388, 87, 307, 332; 348/168; 361/679.06, 679.23, 679.27, 679.55
See application file for complete search history.

(56) References Cited

U.S. PATENT DOCUMENTS

| | | | | |
|---|---|---|---|---|
| 5,197,103 | A | 3/1993 | Hayakawa | |
| 5,825,614 | A * | 10/1998 | Kim | 361/679.55 |
| 5,852,545 | A | 12/1998 | Pan-Ratzlaff | |
| 5,880,928 | A * | 3/1999 | Ma | 361/679.27 |
| 5,979,591 | A | 11/1999 | Harrison | |
| 6,181,550 | B1 * | 1/2001 | Kim | 361/679.06 |
| 6,191,942 | B1 * | 2/2001 | Lee et al. | 361/679.23 |
| 6,243,260 | B1 * | 6/2001 | Lundgren et al. | 361/679.23 |
| 6,292,358 | B1 * | 9/2001 | Lee et al. | 361/679.23 |
| 6,367,579 | B1 | 4/2002 | Wiener | |
| 2007/0064970 | A1 | 3/2007 | Yang et al. | |

FOREIGN PATENT DOCUMENTS

| | | |
|---|---|---|
| TW | 094206782 | 9/2005 |
| TW | M274747 | 9/2005 |

OTHER PUBLICATIONS

Wikipedia, "Loudspeaker enclosure", Printed from Internet Nov. 12, 2009, 10 pgs.

* cited by examiner

*Primary Examiner* — Fan Tsang
*Assistant Examiner* — Phylesha Dabney
(74) *Attorney, Agent, or Firm* — O'Keefe, Egan, Peterman & Enders LLP

(57) ABSTRACT

Sideways-extending speaker apparatus and methods that include a speaker box that is adjustable to fit within given information handling system or electronic device chassis form factor constraints, while also being selectably extendable and expandable to provide increased speaker box volume to achieve improved sound quality performance both in terms of increased speaker spatial separation and wider dynamic range.

24 Claims, 9 Drawing Sheets

SIDEWAYS EXTENDING SPEAKER APPARATUS AND METHODS

FIELD OF THE INVENTION

This invention relates generally to speaker apparatus, and more particularly to speaker apparatus for information handling systems and other electronic devices.

BACKGROUND OF THE INVENTION

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Examples of portable information handling systems include notebook computers. It is known to include speakers that are mounted integral to the chassis of a notebook computer. For example, two integral and upwardly facing loudspeaker drivers may be mounted in speaker boxes provided on each of the opposing sides of a notebook computer keyboard in a stereo configuration. These integral speakers produce sounds generated by electronic components of the computer, e.g., sounds generated by CD or DVD disk playback, streaming audio sounds from digital files received across the Internet, software application and operating system sounds, etc. It is known that increased speaker box volume improves sound performance by extending lower frequency response.

SUMMARY OF THE INVENTION

Disclosed herein are sideways extending speaker apparatus and methods for information handling systems and other electronic devices. The disclosed speaker apparatus may be configured with a speaker box that is adjustable to fit within given information handling system/electronic device chassis form factor constraints, while also being selectably extendable and expandable to provide increased speaker box volume to achieve improved sound quality performance both in terms of increased speaker spatial separation and wider dynamic range. In this regard, the disclosed speaker apparatus may be advantageously configured integral to an information handling system or other electronic device, and to extend and expand from the information handling system in a sideways direction relative to a speaker driver of the speaker box, e.g., in a direction substantially perpendicular to the longitudinal axis of a speaker driver of the speaker box. Thus, the disclosed apparatus and methods may be employed to expand the size of a speaker box for improved sound quality while at the same time conforming the speaker box to shrinking form factors for information handling systems such as notebook computers and netbook computers, and other electronic devices such as computer monitors and portable radios.

In one embodiment, the disclosed adjustable speaker apparatus and methods may employ a sideways-extending speaker box having one or more parts which may be configured to fold in telescoping manner into each other for storage within the chassis of a portable information handling system, and which may be further configured to unfold and extend outward from opposing sides of the portable information handling system for use. In another embodiment, one or more parts of a sideways-extending speaker box may be configured to pivot into each other for storage within the chassis of a portable information handling system, and may be further configured to pivot outward from the sides of the portable information handling system for use. In one exemplary embodiment, the disclosed adjustable speaker apparatus and methods may be extended from the sides of a portable information handling system such as notebook or laptop computer to provide increased speaker spatial separation and increased speaker box volume, improving both sound quality and overall user experience. In such an embodiment, the disclosed adjustable speaker apparatus may be implemented to provide extendable speaker boxes with upward facing loudspeaker drivers that may be extended from the sides of a portable information handling system in a direction that is parallel to the plane of the information handling system keyboard such that the extended speaker boxes remain at or below the level of the keyboard and therefore do not interfere with operation of the keyboard by a user as would, for example, a speaker apparatus embodiment that extended upward from the base portion of an information handling system in a direction that is perpendicular to the plane of the information handling system keyboard.

In one respect, disclosed herein is an information handling system, including: at least one speaker apparatus including an outer speaker cavity and an inner speaker box movably received therein, the inner speaker box having an internal cavity continuous in volume with the outer speaker cavity to form a total combined speaker box volume, the inner speaker box being adjustable between a first position retracted within the outer speaker cavity and a second position extended from the outer speaker cavity such that the total combined speaker box volume when the inner speaker box is extended from the outer speaker cavity is greater than the total combined speaker box volume when the inner speaker box is retracted within the outer speaker cavity; and at least one speaker driver positioned in the inner speaker box, the speaker driver being oriented such that movement of the inner speaker box within the outer speaker cavity from the first retracted position to the second extended position is in a sideways direction relative to the speaker driver.

In another respect, disclosed herein is a speaker apparatus, including: an outer box having an outer speaker cavity defined herein; an inner speaker box movably received within the outer speaker cavity, the inner speaker box having an internal cavity continuous in volume with the outer speaker cavity to form a total combined speaker box volume, the inner speaker box being adjustable between a first position retracted within the outer speaker cavity and a second position extended from the outer speaker cavity such that the total combined speaker box volume when the inner speaker box is extended from the outer speaker cavity is greater than the total combined speaker box volume when the inner speaker box is retracted within the outer speaker cavity; and at least one speaker driver positioned in the inner speaker box, the speaker driver being oriented such that movement of the inner speaker box within the outer speaker cavity from the first retracted position to the second extended position is in a sideways direction relative to the speaker driver.

In yet another respect, disclosed herein is a method of operating a speaker apparatus, including: providing a speaker apparatus including an outer box having an outer speaker cavity defined herein, an inner speaker box movably received within the outer speaker cavity, and at least one speaker driver positioned in the inner speaker box, the inner speaker box having an internal cavity continuous in volume with the outer speaker cavity to form a total combined speaker box volume; and adjusting the inner speaker box between a first position retracted within the outer speaker cavity and a second position extended from the outer speaker cavity n a sideways direction relative to the speaker driver such that the total combined speaker box volume when the inner speaker box is extended from the outer speaker cavity is greater than the total combined speaker box volume when the inner speaker box is retracted within the outer speaker cavity.

DESCRIPTION OF ILLUSTRATIVE EMBODIMENTS

Figure 1:
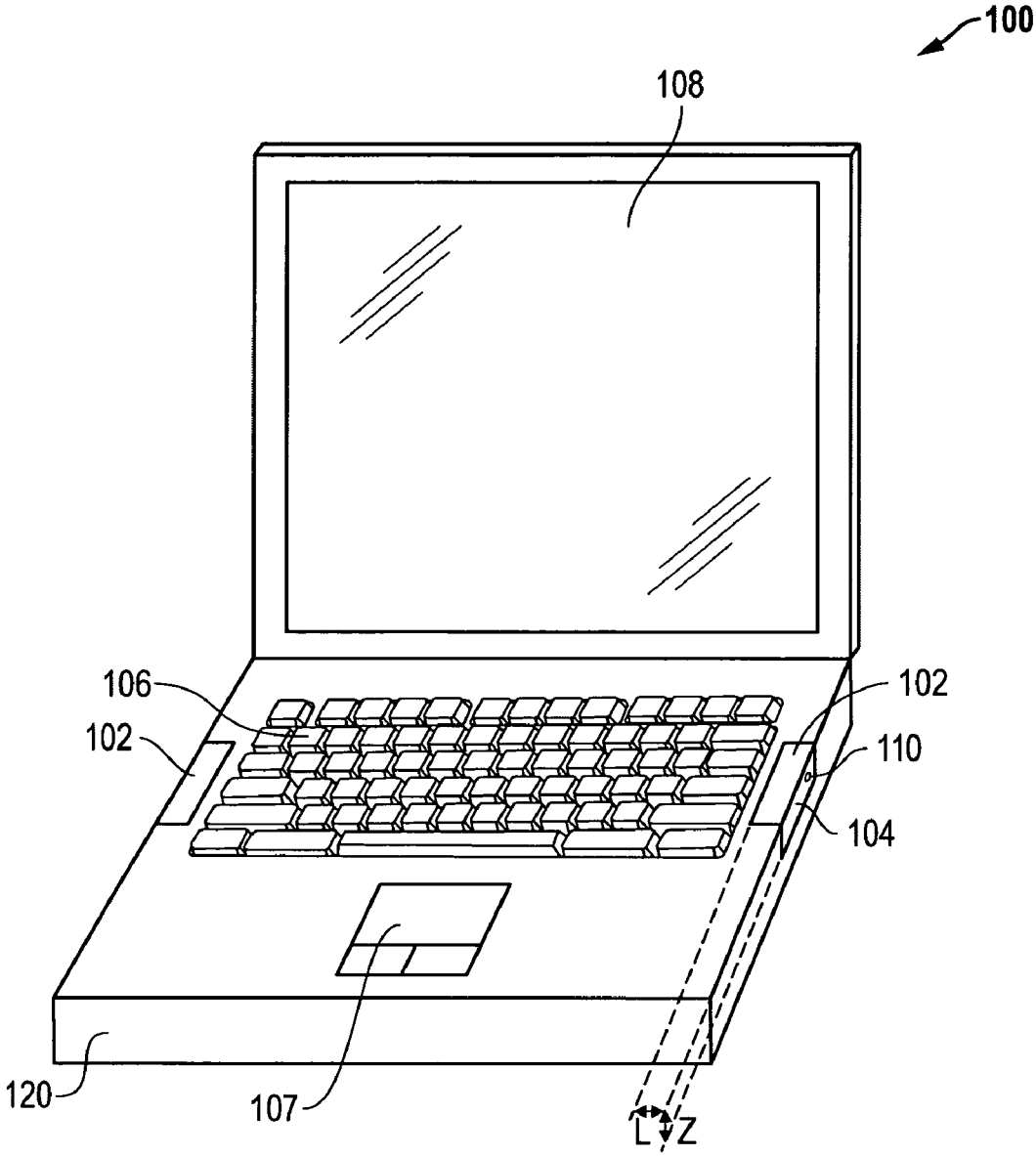
FIG. 1 illustrates a perspective view of an information handling system according to one exemplary embodiment of the disclosed apparatus and methods.
Figure 2:
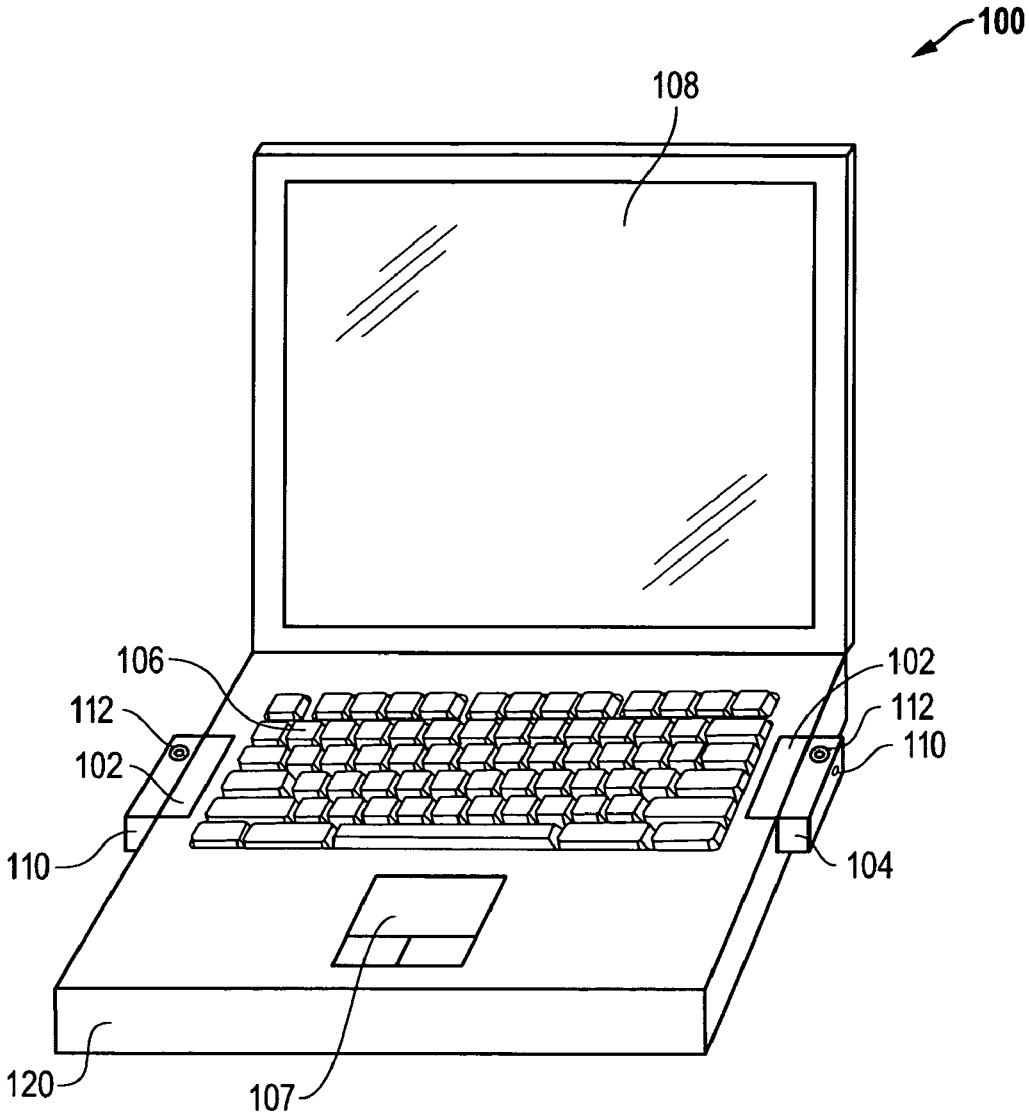
FIG. 2 illustrates a perspective view of an information handling system according to one exemplary embodiment of the disclosed apparatus and methods.

FIGS. 1 and 2 illustrate perspective views of one exemplary embodiment of a portable information handling system that is configured as a notebook computer 100. As shown in FIGS. 1 and 2, notebook computer 100 includes a lid portion 108 (with display) that is hingeably coupled to a base portion 120 that in this embodiment includes input/output devices in the form of a keyboard 106 and touchpad 107. As further shown in FIGS. 1 and 2, notebook computer 100 includes two upward-facing speaker apparatus 102 positioned integral to notebook computer 100 on either side of keyboard 106, e.g., in a left/right stereo speaker configuration. Each of speaker apparatus 102 includes an outer speaker cavity 103 and sideways-extendable inner speaker box component 104 to which at least one upward-facing speaker driver 112 is mounted. Driver 112 may be any suitable speaker driver (e.g., such as a moving-coil speaker), and inner box component 104 also has a cavity defined therein. FIG. 1 shows each speaker apparatus 102 in retracted position such that all components of each speaker apparatus 102 is entirely contained within the outer peripheral dimensions of the base portion 120 of notebook computer 100. FIG. 2 shows each speaker apparatus 102 in sideways-extended position such that extendable inner box component 104 is positioned with upward-facing driver 112 exposed so as to direct sound upward toward a user of notebook computer 100.

Figure 3A:
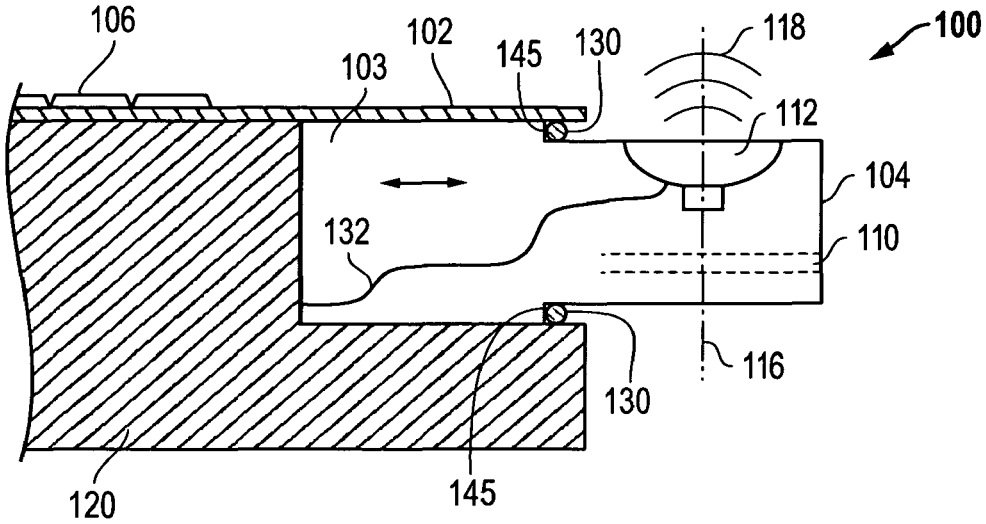
FIG. 3A is a cross-sectional view of a speaker apparatus according to one exemplary embodiment of the disclosed apparatus and methods.

FIG. 3A is a cross-sectional view of one speaker apparatus 102 of notebook computer 100 in sideways-extended position such that the volume space of outer speaker cavity 103 is continuous to the volume of the cavity within inner box component 104. As shown, speaker apparatus 102 includes an outer speaker cavity 103 provided in base portion 120 of notebook computer 100 into which inner speaker box 104 is slideably received in telescoping fashion. Outer speaker cavity 103 may be formed by a separate outer speaker box 105 (e.g., plastic, glass fiber, wood, etc.) that forms part of a two-piece slideable assembly with inner speaker box 104 (e.g., plastic, glass fiber, wood, etc.), or alternatively may be a recessed cavity defined within base portion 120 of notebook computer 100. As further shown, an optional sealing member 130 (e.g., peripheral gasket type seal made of silicone, rubber, felt damper, sponge, etc.) may be provided to form a peripheral acoustic seal between inner speaker box 104 and outer speaker cavity 103 that allows inner speaker box 104 to move relative to outer speaker cavity 103. Inner speaker box 104 is provided as shown with an upwardly-facing speaker driver 112 that is coupled to audio circuitry (e.g., sound card, integrated sound circuitry, etc.) of notebook computer 100 by speaker wire conductor 132.

As indicated by the double-sided arrow in FIG. 3A, inner speaker box 104 is configured in this exemplary embodiment to slide back and forth between extended and retracted position within outer speaker cavity 103 in a direction that is sideways relative to driver 112 of speaker box 104, e.g., substantially perpendicular to the longitudinal axis 116 of driver 112 or substantially perpendicular to the primary direction of sound waves 118 produced by driver 112. Such a speaker box embodiment may be further characterized as non-axially extending in that it does not move between extended and retracted position within outer speaker cavity 103 in a direction that is parallel to the longitudinal axis 116 of driver 112. Movement of inner speaker box 104 between extended and retracted position within outer speaker cavity 103 may be manually accomplished (e.g., by a users fingers or hand) or may be automated (e.g., by compressed spring released by a mechanical switch, by motor that is activated by electric switch or software, etc.). In one embodiment, inner speaker box 104 may be coupled to outer speaker cavity 103 by a push-push (toggle) mechanism that allows inner speaker box 104 to be alternately pushed in to secure inner box 104 in retracted position within outer speaker cavity 103 and then pushed again to be springably released and extended from outer speaker cavity 103.

Figure 3B:
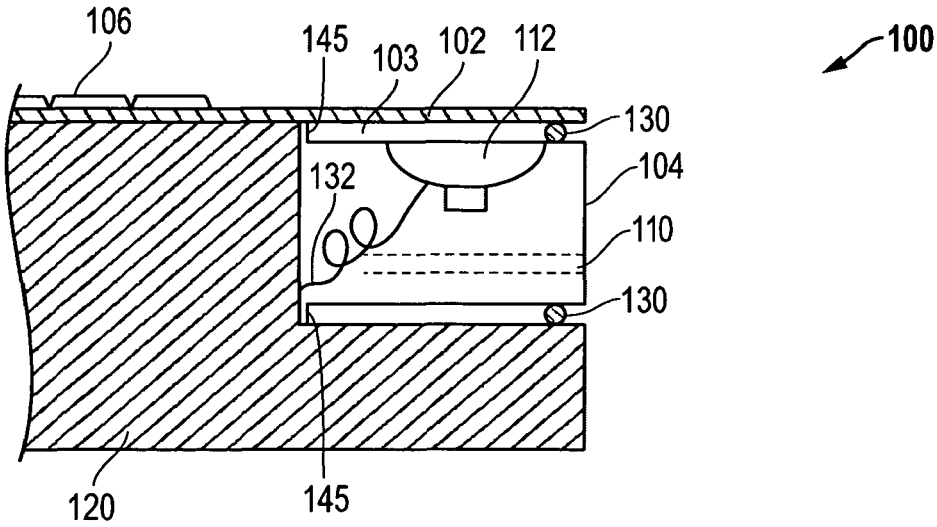
FIG. 3B is a cross-sectional view of a speaker apparatus according to one exemplary embodiment of the disclosed apparatus and methods.

As shown in FIGS. 3A and 3B, an optional sealing member 130 is present in this embodiment on the internal surface of outer speaker cavity 103 to perform the function of providing a substantially air tight sliding seal between outer speaker cavity 103 and inner speaker box 104 so as to form a combined extended speaker box that includes most of the inner volume of cavity 103 and inner speaker box 104. As shown, optional extension stop members 145 may be provided in this embodiment to contact sealing member 130 to prevent inner speaker box 104 from overextending or being removed from outer speaker cavity 103. It will be understood that other types of sealing members and/or extension stop members may be provided.

As further shown in the figures, a bass reflect port 110 may be optionally configured and provided as shown for purposes of extending lower frequency response range by allowing communication of sound and for allowing air to flow for pressure equalization purposes between a cavity defined within inner speaker box 104 and the atmosphere of the environment outside notebook computer 100 as inner speaker box 104 is slid in and out from outer speaker cavity 103. As shown bass reflect port 110 includes an inwardly-extending open conduit that is coupled to an opening in speaker box 104, and which may be provided to transmit low-frequency energy from the rear of the speaker to the user. When present, bass reflect port 110 also may be present to allow an opening for exit of sound produced by driver 112 when inner speaker box 104 is in retracted position within outer speaker cavity 103 as shown in FIG. 3B. Force necessary for imparting sideways movement to inner speaker box component 104 may be provided, for example, by manual manipulation of the speaker box 104 by the fingers of a user.

FIG. 3B is a cross-sectional view of speaker apparatus 102 of FIG. 3A in retracted position within notebook computer 100. As shown in FIG. 3B, inner speaker box 104 has been retracted into outer speaker cavity 103 such that inner speaker box 104 is substantially contained within the outer peripheral dimensions and form factor of base portion 120 of notebook computer 100. The surface of base portion 120 immediately above driver 112 and inner speaker box 104 is non-permeable to sound in this embodiment. In this embodiment the When inner speaker box 104 is in sideways extended position as shown in FIG. 3A, it may be seen that the combined interior volume made available to driver 112 by outer speaker cavity 103 and inner speaker box 104 is greater (e.g., about 80% greater in one embodiment) than when inner speaker box 104 is retracted into outer speaker cavity 103 as shown in FIG. 3B. This increased volume results in extension of lower frequency speaker response.

Figure 4:
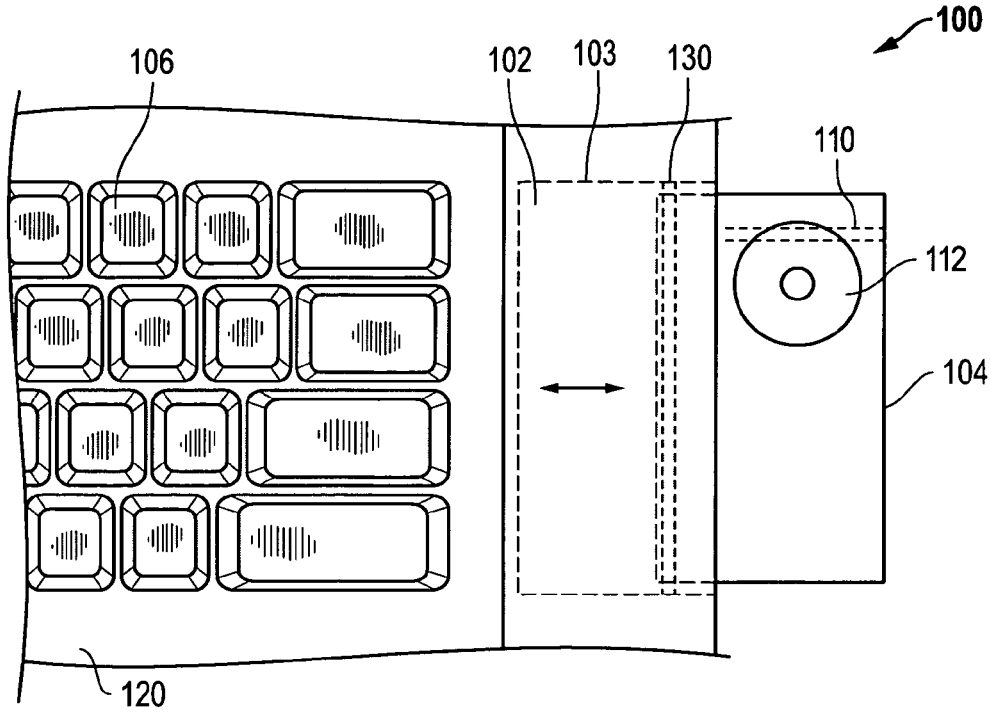
FIG. 4 is a partial overhead top view of an information handling system according to one exemplary embodiment of the disclosed apparatus and methods.
Figure 5:
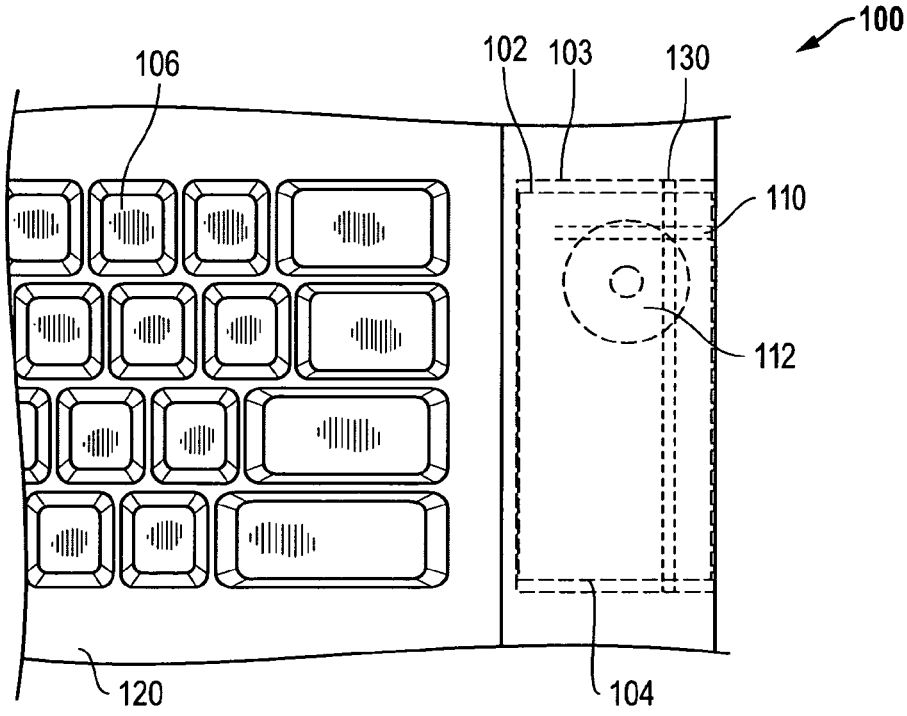
FIG. 5 is a partial overhead top view of an information handling system according to one exemplary embodiment of the disclosed apparatus and methods.

FIG. 4 is a partial overhead view showing one speaker apparatus 102 of notebook computer 100 in sideways-extended position and corresponds to FIG. 3A. FIG. 5 is a partial overhead top view of one speaker apparatus 102 of notebook computer 100 in retracted position within notebook computer 100 and corresponds to FIG. 3B. When inner speaker box 104 is in sideways extended position as shown in FIG. 4, it may be seen that the position of driver 112 is located outboard relative to the side surface of notebook computer 100, i.e., driver 112 is located in a position extending beyond the outer peripheral dimensions of notebook computer 100. Turning to FIG. 2, it may be further seen in FIG. 2 that the distance between the two drivers 112 is increased beyond the width of notebook computer 100 when they are each placed in sideways extended position, resulting in increased spatial separation from each other and improved stereo separation experience for the user of notebook computer 100.

Figure 6:
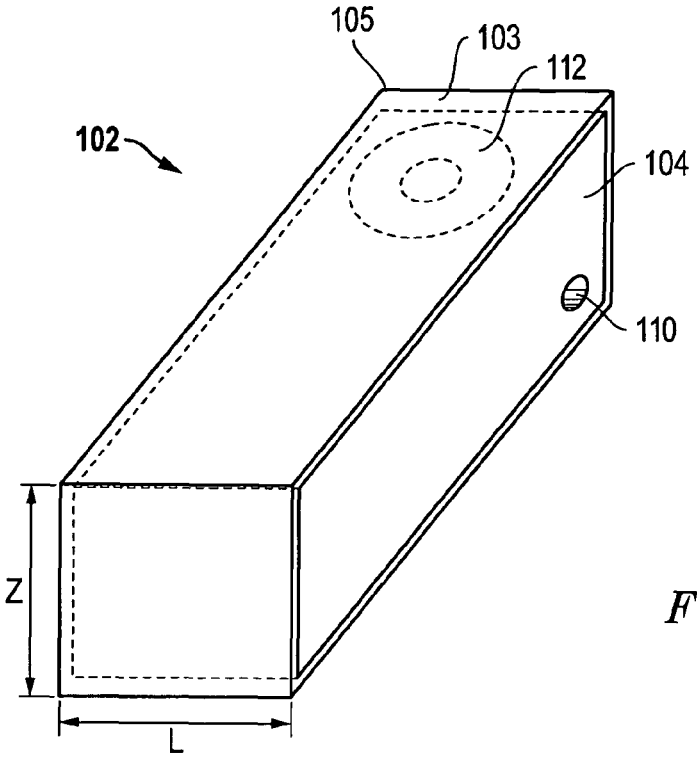
FIG. 6 is a perspective view of a speaker apparatus according to one exemplary embodiment of the disclosed apparatus and methods.
Figure 7:
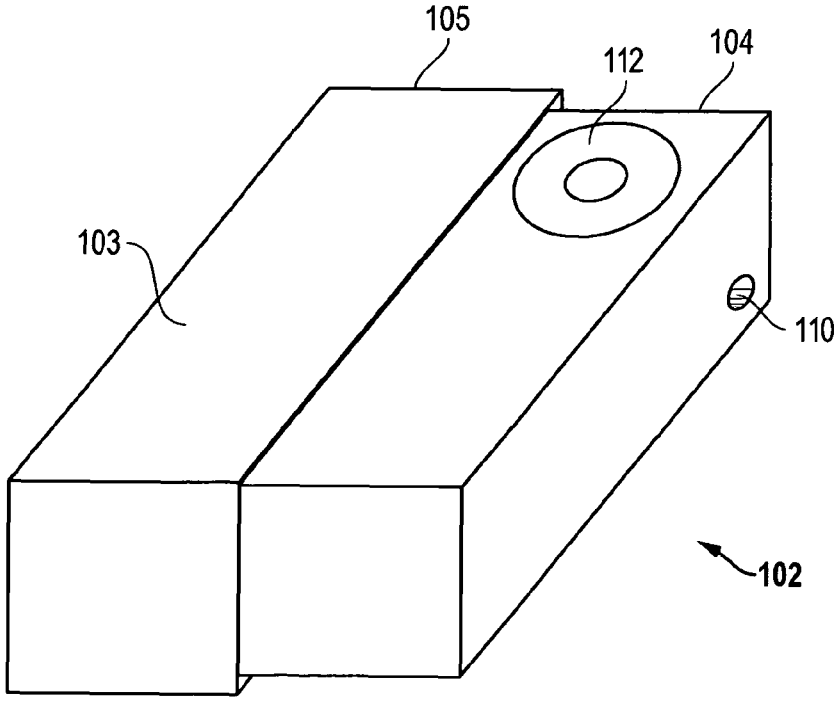
FIG. 7 is a perspective view of a speaker apparatus according to one exemplary embodiment of the disclosed apparatus and methods.

FIGS. 6 and 7 illustrate perspective views of one exemplary embodiment of a speaker apparatus 102 that is configured as a multi-piece assembly of an outer box 105 and inner speaker box 104. Outer speaker cavity 103 is defined within outer box 105 and dimensioned to slideably receive inner speaker box 104 with driver 112 as shown. As further shown, speaker apparatus assembly 102 of FIGS. 6 and 7 may have a height (Z) dimension and a length (L) dimension that may be dictated by the overall dimensions of the information handling system. In the case of this embodiment, Z is limited by the thickness of base portion 120 of notebook computer 100 minus thickness of any underlying component/s (e.g., such as optical disk drive, battery and/or battery compartment, etc.) and such that inner speaker box 104 may be slideably received within outer speaker cavity 105 in the manner shown. As shown in the figures, inner speaker box 104 extends sideways from outer speaker cavity of outer box 105 within the Z dimension of speaker apparatus 102.

Figure 8:
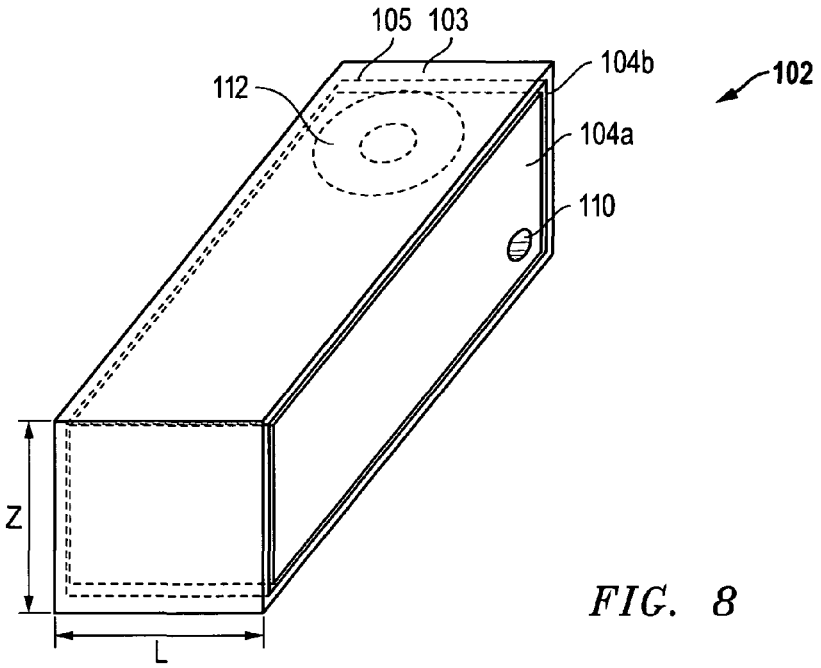
FIG. 8 is a perspective view of a speaker apparatus according to one exemplary embodiment of the disclosed apparatus and methods.
Figure 9:
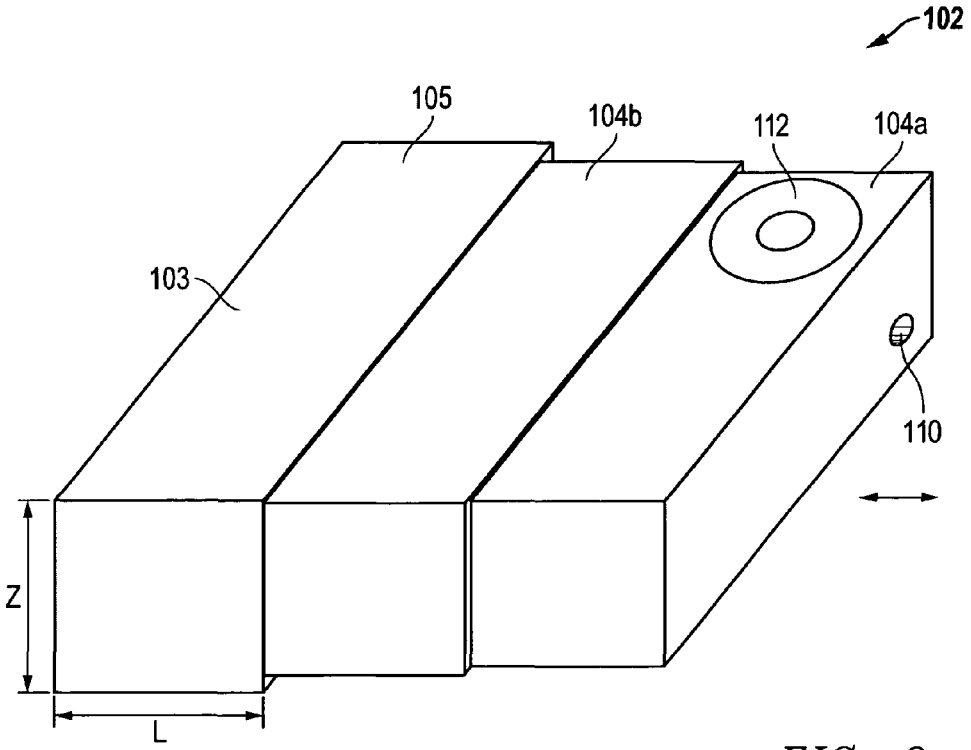
FIG. 9 is a perspective view of a speaker apparatus according to one exemplary embodiment of the disclosed apparatus and methods.

It will be understood that where sufficient space in an information handling system or other electronic component exists to allow a sufficiently large Z dimension, a speaker apparatus 102 may be configured with more than one sideways-extending inner speaker box component 104. For example, FIGS. 8 and 9 illustrate perspective views of one exemplary embodiment of a speaker apparatus 102 that is configured with an outer box 105 and first and second inner speaker box components 104*a* and 104*b* which each have an inner cavity defined therein. In this embodiment, outer speaker cavity 103 is once again defined within outer box 105 and dimensioned to slideably receive second inner speaker box 104*b*. Second inner speaker box 104*b* is in turn configured to slideably receive first inner speaker box 104*a* with driver 112 as shown. When inner speaker boxes 104*a* and 104*b* are in sideways extended position as shown in FIG. 9, it may be seen that the position of driver 112 is located outboard relative to the side surface of notebook computer 100, i.e., driver 112 is located in a position beyond the outer dimensions of notebook computer 100.

In a multiple extendable speaker box embodiment such as FIGS. 8 and 9, the provision of more than one extendable speaker box 104 within the same size outer speaker cavity 103 allows for greater separation of speaker drivers 112 when extended than a single speaker box 104, and also provides greater total speaker box volume than a single speaker box 104, thus allow greater lower frequency response to be achieved. In this regard, as many extendable speaker boxes 104 may be provided in telescoping style as is allowed by the available Z dimension for the given application. Such an embodiment may be particularly useful with information handling systems or other electronic devices having relatively thick or spacious chassis, e.g., such as desktop computer monitors, "all in one" desktop computers, etc.

Figure 10:
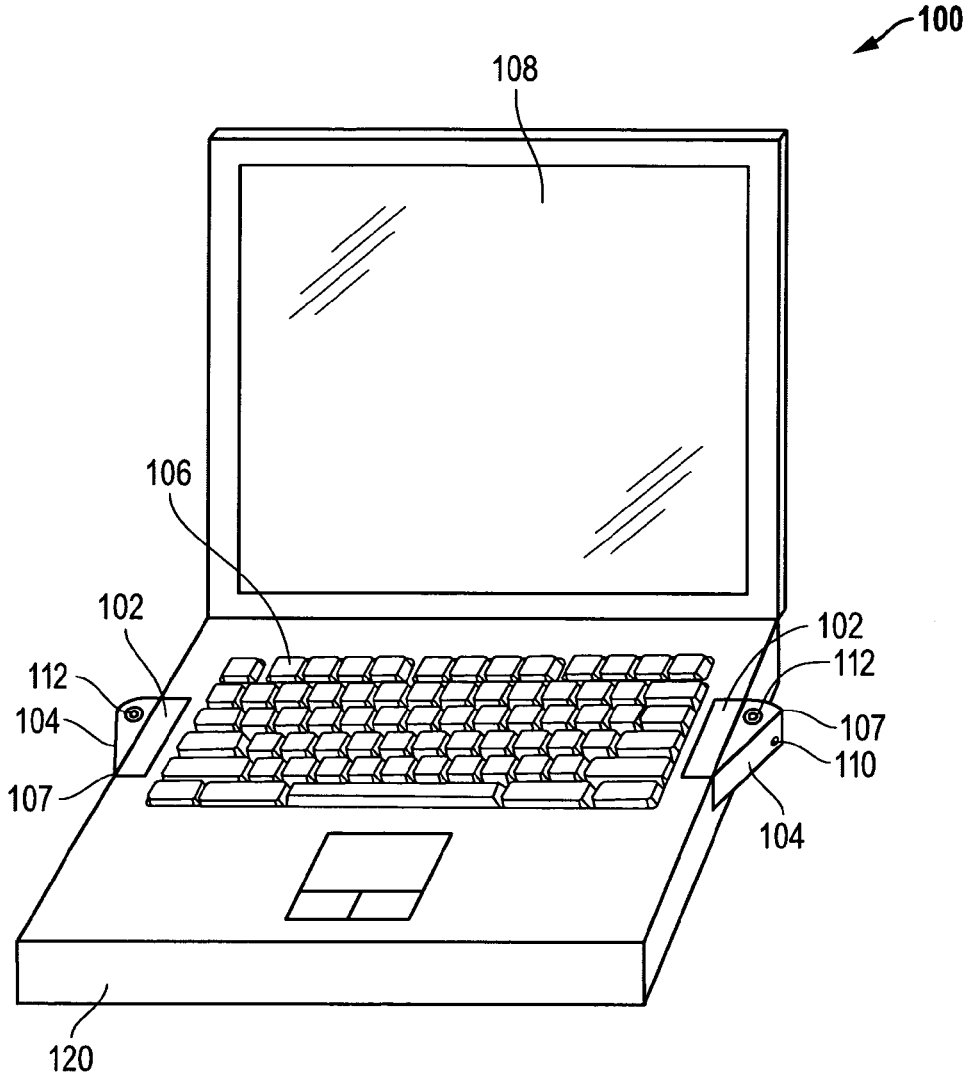
FIG. 10 illustrates a perspective view of an information handling system according to one exemplary embodiment of the disclosed apparatus and methods.

FIG. 10 illustrates another exemplary embodiment in which notebook computer 100 includes two speaker apparatus 102 that each include at least one upwardly-facing driver 112 that are similarly positioned as in the embodiment of FIG.

10. However, in the embodiment of FIG. 10, each of speaker apparatus 102 includes an outer speaker cavity 103 and sideways-extendable inner speaker box component 104 that is pivotably coupled therein at a pivot point 109. Pivot point 109 may be a hinge pin or axle, or may be one or more fasteners or any other suitable pivot component. FIG. 10 shows each speaker apparatus 102 in sideways extended position such that pie-shaped extendable inner box component 104 of each apparatus 102 is positioned with upward-facing driver 112 exposed so as to direct sound upward toward a user of notebook computer 100.

Figure 11:
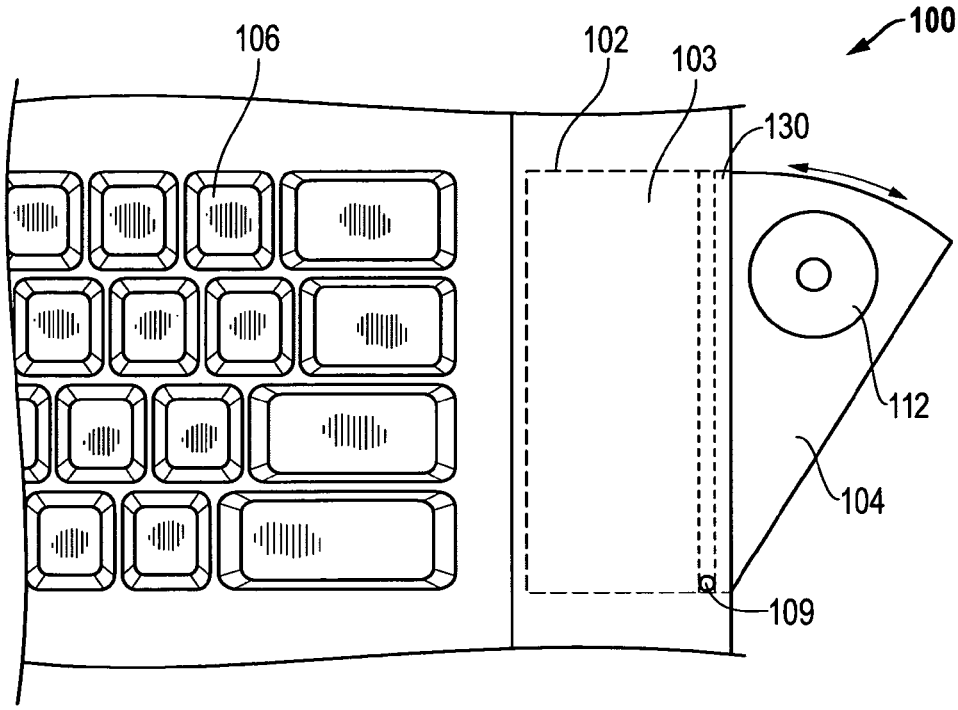
FIG. 11 is a partial overhead top view of an information handling system according to one exemplary embodiment of the disclosed apparatus and methods.
Figure 12:
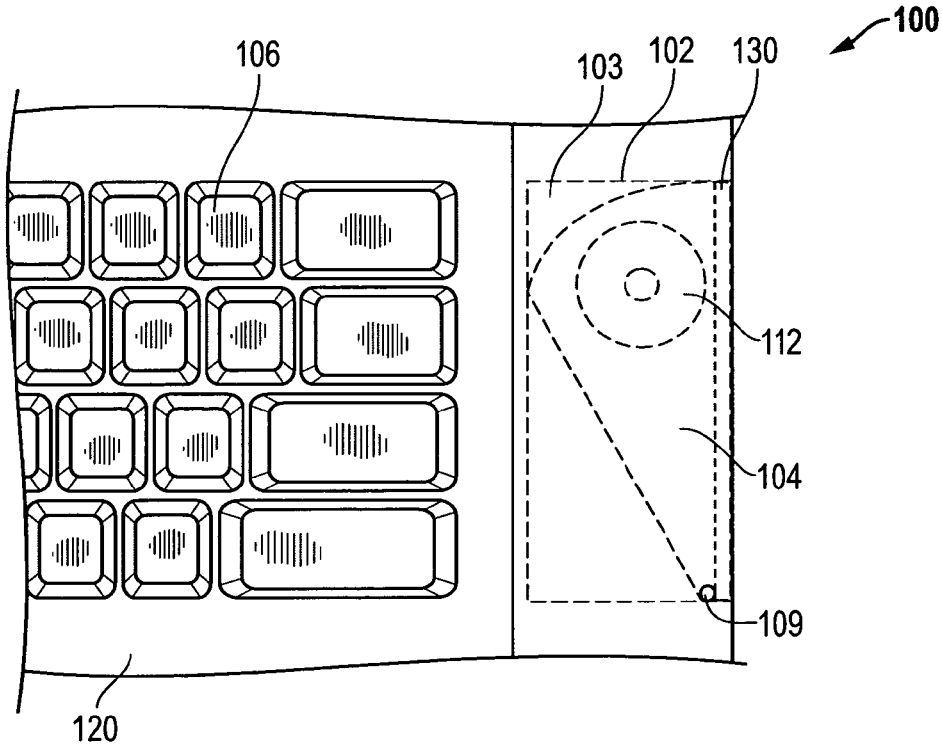
FIG. 12 is a partial overhead top view of an information handling system according to one exemplary embodiment of the disclosed apparatus and methods.
Figure 13:
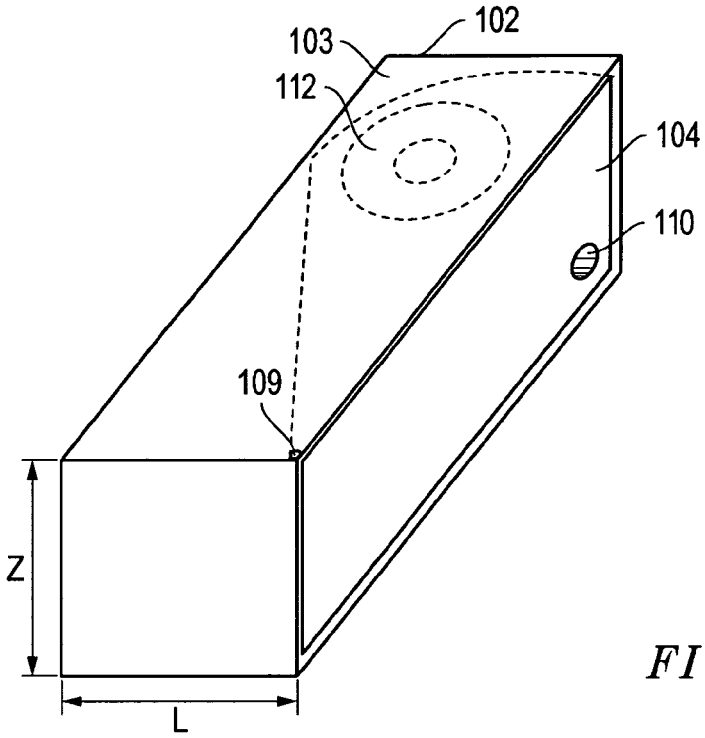
FIG. 13 is a perspective view of a speaker apparatus according to one exemplary embodiment of the disclosed apparatus and methods.
Figure 14:
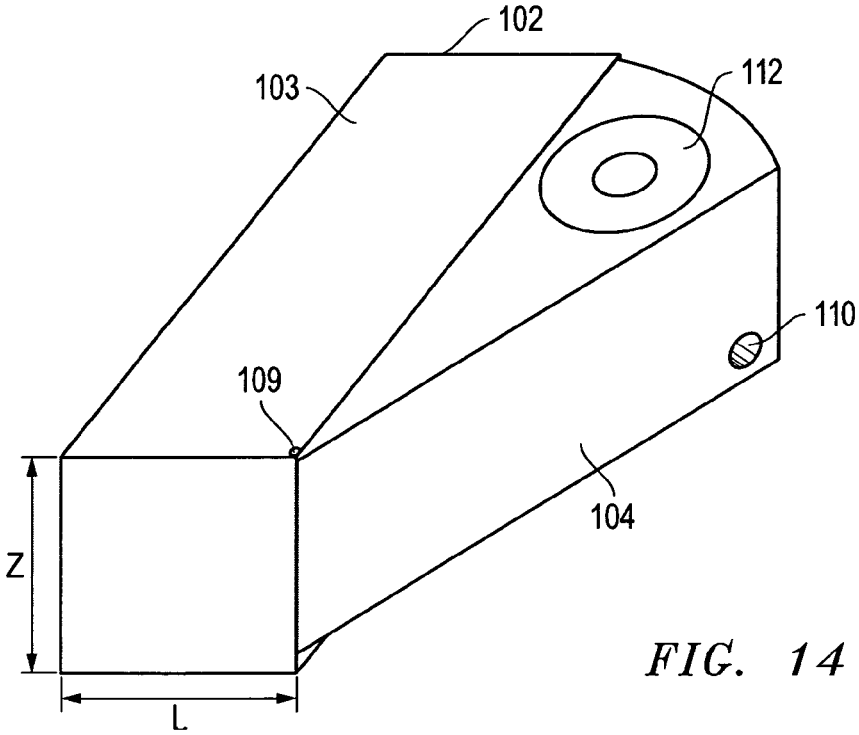
FIG. 14 is a perspective view of a speaker apparatus according to one exemplary embodiment of the disclosed apparatus and methods.

FIG. 11 is partial overhead view of one speaker apparatus 102 of notebook computer 100 in sideways-extended position corresponding to FIG. 10. FIG. 12 is a partial overhead view of one speaker apparatus 102 of notebook computer 100 in retracted position within notebook computer 100. FIGS. 13 and 14 illustrate one exemplary embodiment of a speaker apparatus 102 that is configured as a multi-piece assembly of an outer box 105 and inner speaker box 104 corresponding to the embodiment of FIGS. 10-12. Outer speaker cavity 103 is defined within outer box 105 and dimensioned to slideably receive inner speaker box 104 with driver 112 as shown.

Although an exemplary notebook computer embodiment is illustrated herein, it will be understood that the disclosed speaker apparatus may be employed to provide an integral speaker configuration to a variety of types of information handling systems, e.g., PDA, netbook computer, smart phone, etc. Furthermore, it will be understood that in other embodiments an information handling system may be configured with a single integral speaker apparatus or more than two integral speaker apparatus, and or that speaker apparatus may be positioned to extend from any one or more surfaces (e.g., side, top, bottom, front, back, notebook display lid, etc.) of an information handling system or other electronic device with a speaker driver facing in any desired direction relative to the information handling system. Additionally, components of the disclosed speaker apparatus (e.g., outer cavity 103, inner box 104, etc.) may be of any size and/or shape that is suitable for supporting and extending one or more speaker drivers sideways from the surface of an information handling system.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed apparatus and methods may be utilized in various combinations and/or independently. Thus the invention is not limited to only those combinations shown herein, but rather may include other combinations.

What is claimed is:

1. An information handling system, comprising:

at least one speaker apparatus including an outer speaker cavity and an inner speaker box movably received therein, the inner speaker box having an internal cavity continuous in volume with the outer speaker cavity to form a total combined speaker box volume, the inner speaker box being adjustable between a first position retracted within the outer speaker cavity and a second position extended from the outer speaker cavity such that the total combined speaker box volume when the inner speaker box is extended from the outer speaker cavity is greater than the total combined speaker box volume when the inner speaker box is retracted within the outer speaker cavity; and at least one speaker driver positioned in the inner speaker box, the speaker driver being oriented such that movement of the inner speaker box within the outer speaker cavity from the first retracted position to the second extended position is in a sideways direction relative to the speaker driver;

where the internal cavity of the inner speaker box has an internal volume space, and where the outer speaker cavity has an internal volume space, the inner speaker box being configured to be retracted within the internal volume space of the outer speaker cavity when the inner speaker box is in the first position retracted within the outer speaker cavity; and where the internal volume space of the outer speaker cavity is configured to be open to and continuous with the internal volume space of the inner box when the inner speaker box is extended from the outer speaker cavity to form a combined extended speaker box that includes at least a portion of the internal volume space of the outer speaker cavity combined with at least a portion of the internal volume space of the internal cavity of the inner speaker box such that the total combined speaker box volume made available to the speaker driver when the inner speaker box is extended from the outer speaker cavity is greater than the total combined speaker box volume made available to the speaker driver when the inner speaker box is retracted within the outer speaker cavity.

2. The information handling system of claim 1, wherein the information handling system is a notebook computer having a base portion, and an integral keyboard disposed within the base portion; wherein the at least one speaker apparatus is integral to the base portion and disposed in a position adjacent one side of the keyboard with the at least one speaker driver facing upward relative to the plane of the keyboard; and the inner speaker box is adjustable between the first position retracted within the outer speaker cavity and the second position extended from the outer speaker cavity in a direction that is substantially parallel to the plane of the keyboard.

3. The information handling system of claim 1, wherein the information handling system is a notebook computer having a base portion, and further comprises an integral keyboard disposed within the base portion; wherein the keyboard has an upper surface for receiving keystrokes from a user with the at least one speaker driver facing upward toward the user; wherein the speaker apparatus does not extend above the level of the upper keyboard surface when the inner speaker box is in the first retracted position; and wherein the inner speaker box is adjustable between the first position retracted within the outer speaker cavity and the second position extended from the outer speaker cavity in a direction that is substantially parallel to the plane of the keyboard such that the inner speaker box remains does not extend above the level of the upper keyboard surface when the inner speaker box is in its second extended position.

4. The information handling system of claim 1, wherein the information handling system is a notebook computer having a base portion, and further comprises an integral keyboard disposed within the base portion; wherein the at least one speaker apparatus is integral to the base portion and disposed in a position adjacent one side of the keyboard with the at least one speaker driver facing upward relative to the plane of the keyboard; and the inner speaker box is adjustable between the first position retracted within the outer speaker cavity such that all components of the speaker apparatus are substantially entirely contained within the outer peripheral dimensions of the base portion of the notebook computer and the second position extended from the outer speaker cavity in a direction that is substantially parallel to the plane of the keyboard such that the at least one driver is positioned beyond the outer peripheral dimensions of the base portion of the notebook computer.

5. The information handling system of claim 1, wherein the information handling system is a notebook computer having a base portion, and further comprises an integral keyboard disposed within the base portion; wherein the at least one speaker apparatus comprises two speaker apparatus integral to the base portion that are disposed in positions adjacent opposite sides of the keyboard with the at least one speaker driver of each speaker apparatus facing upward relative to the plane of the keyboard; and the inner speaker box of each speaker apparatus being adjustable between the first position retracted within the outer speaker cavity and the second position extended from the outer speaker cavity in a direction that is substantially parallel to the plane of the keyboard and opposite from the extended position of the other speaker apparatus such that the spatial separation of the speaker drivers of the two speaker apparatus when in the extended position is greater than the spatial separation of the two speaker drivers of the two speaker apparatus when in the retracted position.

6. The information handling system of claim 1, where the inner speaker box comprises first and second inner speaker boxes, the first inner speaker box being movably received in the second inner speaker box and the second inner speaker box being movably received within the outer speaker cavity, the first and second inner speaker boxes each having an internal cavity with an internal volume space and continuous in volume with the outer speaker cavity to form a total combined speaker box volume, the second inner speaker box being adjustable between a first position retracted within the outer speaker cavity and a second position extended from the outer speaker cavity and the first inner speaker box being adjustable between a first position retracted within the second inner speaker box and a second position extended from the second inner speaker box such that the first and second inner speaker boxes are configured to be retracted within the internal volume space of the outer speaker cavity and such that the total combined speaker box volume made available to the speaker driver when the first and second inner speaker boxes are extended from the outer speaker cavity is greater than the total combined speaker box volume made available to the speaker driver when the first and second inner speaker boxes are retracted within the outer speaker cavity.

7. The information handling system of claim 1, further comprising a bass reflect port, the bass reflect port including an inwardly-extending open conduit that is coupled to an opening defined in a side of the inner speaker box to provide communication for air and sound waves between the internal cavity of the inner speaker box and an atmosphere of an environment external to the information handling system.

8. The information handling system of claim 1, wherein the inner speaker box is configured to be slideably received within the outer speaker cavity in a telescoping manner.

9. The information handling system of claim 1, wherein the inner speaker box is configured to pivot around a pivot point and to be pivotably and slideably received within the outer speaker cavity.

10. The information handling system of claim 1, wherein the speaker driver is oriented such that movement of the inner speaker box within the outer speaker cavity from the first retracted position to the second extended position is in a non-axial direction relative to the speaker driver.

11. A speaker apparatus, comprising:

an outer box having an outer speaker cavity defined herein;

an inner speaker box movably received within the outer speaker cavity, the inner speaker box having an internal cavity continuous in volume with the outer speaker cavity to form a total combined speaker box volume, the inner speaker box being adjustable between a first position retracted within the outer speaker cavity and a second position extended from the outer speaker cavity such that the total combined speaker box volume when the inner speaker box is extended from the outer speaker cavity is greater than the total combined speaker box volume when the inner speaker box is retracted within the outer speaker cavity;

at least one speaker driver positioned in the inner speaker box, the speaker driver being oriented such that movement of the inner speaker box within the outer speaker cavity from the first retracted position to the second extended position is in a sideways direction relative to the speaker driver;

a sealing member configured to form a peripheral acoustic seal between the inner speaker box and the outer speaker cavity speaker cavity when the inner speaker box is extended from the outer speaker cavity; and that allows the inner speaker box to move relative to the outer speaker cavity; and where the sealing member is configured to form a substantially air tight sliding peripheral acoustic seal between the inner speaker box and the outer speaker cavity when he inner speaker box is extended from the outer speaker cavity so as to form a combined extended speaker box that includes at least a portion of an internal volume space of the outer speaker cavity combined with at least a portion of an internal volume space of the internal cavity of the inner speaker box sealed together in a peripheral air tight manner by the sealing member.

12. The speaker apparatus of claim 11, where the inner speaker box comprises first and second inner speaker boxes, the first inner speaker box being movably received in the second inner speaker box and the second inner speaker box being movably received within the outer speaker cavity, the first and second inner speaker boxes each having an internal cavity with an internal volume space and continuous in volume with the outer speaker cavity to form a total combined speaker box volume, the second inner speaker box being adjustable between a first position retracted within the outer speaker cavity and a second position extended from the outer speaker cavity and the first inner speaker box being adjustable between a first position retracted within the second inner speaker box and a second position extended from the second inner speaker box such that the first and second inner speaker boxes are configured to be retracted within the internal volume space of the outer speaker cavity and such that the total combined speaker box volume made available to the speaker driver when the first and second inner speaker boxes are extended from the outer speaker cavity is greater than the total combined speaker box volume made available to the speaker driver when the first and second inner speaker boxes are retracted within the outer speaker cavity.

13. The speaker apparatus of claim 11, further comprising a bass reflect port, the bass reflect port including an inwardly-extending open conduit that is coupled to an opening defined in a side of the inner speaker box to provide communication for air and sound waves between the internal cavity of the inner speaker box and an atmosphere of an environment external to the total combined speaker box volume.

14. The speaker apparatus of claim 11, wherein the inner speaker box is configured to be slideably received within the outer speaker cavity in a telescoping manner.

15. The speaker apparatus of claim 11, wherein the inner speaker box is configured to pivot around a pivot point and to be pivotably and slideably received within the outer speaker cavity.

16. The speaker apparatus of claim 11, wherein the speaker driver is oriented such that movement of the inner speaker box within the outer speaker cavity from the first retracted position to the second extended position is in a non-axial direction relative to the speaker driver.

17. A method of operating a speaker apparatus, comprising:

providing a speaker apparatus including an outer box having an outer speaker cavity defined herein, an inner speaker box movably received within the outer speaker cavity, and at least one speaker driver positioned in the inner speaker box, the inner speaker box having an internal cavity continuous in volume with the outer speaker cavity to form a total combined speaker box volume; and adjusting the inner speaker box between a first position retracted within the outer speaker cavity and a second position extended from the outer speaker cavity n a sideways direction relative to the speaker driver such that the total combined speaker box volume when the inner speaker box is extended from the outer speaker cavity is greater than the total combined speaker box volume when the inner speaker box is retracted within the outer speaker cavity;

where the internal cavity of the inner speaker box has an internal volume space, and where the outer speaker cavity has an internal volume space; where the inner speaker box is retracted within the internal volume space of the outer speaker cavity when the inner speaker box is in the first position retracted within the outer speaker cavity; and where the internal volume space of the outer speaker cavity is open to and continuous with the internal volume space of the inner box when the inner speaker box is extended from the outer speaker cavity in the second position to form a combined extended speaker box that includes at least a portion of the internal volume space of the outer speaker cavity combined with at least a portion of the internal volume space of the internal cavity of the inner speaker box such that the total combined speaker box volume made available to the speaker driver when the inner speaker box is extended from the outer speaker cavity is greater than the total combined speaker box volume made available to the speaker driver when the inner speaker box is retracted within the outer speaker cavity.

18. The method of claim 17, further comprising providing the speaker apparatus as part of an information handling system.

19. The method of claim 17, further comprising providing the speaker apparatus as part of a notebook computer having a base portion, and an integral keyboard disposed within the base portion, the at least one speaker apparatus being integral to the base portion and disposed in a position adjacent one side of the keyboard with the at least one speaker driver facing upward relative to the plane of the keyboard and a user of the keyboard; and adjusting the inner speaker box between the first position retracted within the outer speaker cavity and the second position extended from the outer speaker cavity in a direction that is substantially parallel to the plane of the keyboard.

20. The method of claim 17, further comprising providing the speaker apparatus as part of a notebook computer having a base portion, and an integral keyboard disposed within the base portion, the at least one speaker apparatus being integral to the base portion and disposed in a position adjacent one side of the keyboard with the at least one speaker driver facing upward relative to the plane of the keyboard and a user of the keyboard; and adjusting the inner speaker box between the first position retracted within the outer speaker cavity such that all components of the speaker apparatus are substantially entirely contained within the outer peripheral dimensions of the base portion of the notebook computer and the second position extended from the outer speaker cavity in a direction that is substantially parallel to the plane of the keyboard such that the at least one driver is positioned beyond the outer peripheral dimensions of the base portion of the notebook computer.

21. The method of claim 17, further comprising providing the speaker apparatus as two speaker apparatus as part of a notebook computer having a base portion, and an integral keyboard disposed within the base portion, the two apparatus being integral to the base portion and disposed in positions adjacent opposite sides of the keyboard with the at least one speaker driver of each speaker apparatus facing upward relative to the plane of the keyboard; and adjusting the inner speaker box of each speaker apparatus between the first position retracted within the outer speaker cavity and the second position extended from the outer speaker cavity in a direction that is substantially parallel to the plane of the keyboard and opposite from the extended position of the other speaker apparatus such that the spatial separation of the speaker drivers of the two speaker apparatus when in the extended position is greater than the spatial separation of the two speaker drivers of the two speaker apparatus when in the retracted position.

22. A method of operating a speaker apparatus, comprising:

providing a speaker apparatus including an outer box having an outer speaker cavity defined herein, an inner speaker box movably received within the outer speaker cavity, and at least one speaker driver positioned in the inner speaker box, the inner speaker box having an internal cavity continuous in volume with the outer speaker cavity to form a total combined speaker box volume; and adjusting the inner speaker box between a first position retracted within the outer speaker cavity and a second position extended from the outer speaker cavity in a sideways direction relative to the speaker driver such that the total combined speaker box volume when the inner speaker box is extended from the outer speaker cavity is greater than the total combined speaker box volume when the inner speaker box is retracted within the outer speaker cavity;

where the speaker apparatus further comprises a sealing member configured to form a substantially air tight sliding peripheral acoustic seal between the inner speaker box and the outer speaker cavity when the inner speaker box is extended from the outer speaker cavity in the second position; and where the method further comprises adjusting the inner speaker box between the first position and the second position by sliding the inner speaker box within the sealing member in a direction outwardly from the outer speaker cavity so as to form a combined extended speaker box that includes at least a portion of an internal volume space of the outer speaker cavity combined with at least a portion of an internal volume space of the internal cavity of the inner speaker box sealed together in a peripheral air tight manner by the sealing member.

23. An information handling system, comprising:

at least one speaker apparatus including an outer speaker cavity and an inner speaker box movably received therein, the inner speaker box having an internal cavity continuous in volume with the outer speaker cavity to form a total combined speaker box volume, the inner speaker box being adjustable between a first position retracted within the outer speaker cavity and a second position extended from the outer speaker cavity such that the total combined speaker box volume when the inner speaker box is extended from the outer speaker cavity is greater than the total combined speaker box volume when the inner speaker box is retracted within the outer speaker cavity; and at least one speaker driver positioned in the inner speaker box, the speaker driver being oriented such that movement of the inner speaker box within the outer speaker cavity from the first retracted position to the second extended position is in a sideways direction relative to the speaker driver; and where the system further comprises first and second inner speaker boxes, the first inner speaker box being movably received in the second inner speaker box and the second inner speaker box being movably received within the outer speaker cavity, the first and second inner speaker boxes each having an internal cavity continuous in volume with the outer speaker cavity to form a total combined speaker box volume, the second inner speaker box being adjustable between a first position retracted within the outer speaker cavity and a second position extended from the outer speaker cavity and the first inner speaker box being adjustable between a first position retracted within the second inner speaker box and a second position extended from the second inner speaker box such that the total combined speaker box volume when the first and second inner speaker boxes are extended from the outer speaker cavity is greater than the total combined speaker box volume when the first and second inner speaker boxes are retracted within the outer speaker cavity.

24. A speaker apparatus, comprising:

an outer box having an outer speaker cavity defined herein;

an inner speaker box movably received within the outer speaker cavity, the inner speaker box having an internal cavity continuous in volume with the outer speaker cavity to form a total combined speaker box volume, the inner speaker box being adjustable between a first position retracted within the outer speaker cavity and a second position extended from the outer speaker cavity such that the total combined speaker box volume when the inner speaker box is extended from the outer speaker cavity is greater than the total combined speaker box volume when the inner speaker box is retracted within the outer speaker cavity; and at least one speaker driver positioned in the inner speaker box, the speaker drive being oriented such that movement of the inner speaker box within the outer speaker cavity from the first retracted position to the second extended position is in a sideways direction relative to the speaker driver;

where the speaker apparatus further comprises first and second inner speaker boxes, the first inner speaker box being movably received in the second inner speaker box and the second inner speaker box being movably received within the outer speaker cavity, the first and second inner speaker boxes each having an internal cavity continuous in volume with the outer speaker cavity to form a total combined speaker box volume, the second inner speaker box being adjustable between a first position retracted within the outer speaker cavity and a second position extended from the outer speaker cavity and the first inner speaker box being adjustable between a first position retracted within the second inner speaker box and a second position extended from the second inner speaker box such that the total combined, speaker box volume when the first and second inner speaker boxes are extended from the outer speaker cavity is greater than the total combined speaker box volume when the first and second inner speaker boxes are retracted within the outer speaker cavity.

* * * * *